US009650919B2

(12) United States Patent
Whitty et al.

(10) Patent No.: US 9,650,919 B2
(45) Date of Patent: May 16, 2017

(54) MOVEABLE SEALING ARRANGEMENT FOR A GAS TURBINE DIFFUSER GAP

(71) Applicant: Siemens Energy, Inc., Orlando, FL (US)

(72) Inventors: Michael Whitty, West Hartford, CT (US); Jeffrey D. Kesten, West Hartford, CT (US); Yevgeniy P. Shteyman, West Palm Beach, FL (US); Cristina Cook, Cromwell, CT (US); Keith J. Gordon, West Palm Beach, FL (US)

(73) Assignee: Siemens Energy, Inc., Orlando, FL (US)

( * ) Notice: Subject to any disclaimer, the term of this patent is extended or adjusted under 35 U.S.C. 154(b) by 397 days.

(21) Appl. No.: 14/450,338

(22) Filed: Aug. 4, 2014

(65) Prior Publication Data

US 2016/0032781 A1 Feb. 4, 2016

(51) Int. Cl.
*F01D 25/30* (2006.01)
*F01D 9/04* (2006.01)
*F01D 11/00* (2006.01)

(52) U.S. Cl.
CPC ..... *F01D 25/30* (2013.01); *F01D 9/04* (2013.01); *F01D 11/005* (2013.01)

(58) Field of Classification Search
CPC ..... F01D 9/04; F01D 11/00; F01D 11/003; F01D 11/005; F01D 25/30; F01D 25/24
USPC ..... 277/311, 630, 637, 921; 415/110, 170.1, 415/174.3, 214.1, 230
See application file for complete search history.

(56) References Cited

U.S. PATENT DOCUMENTS 5,104,286 A 4/1992 Donlan
6,065,756 A * 5/2000 Eignor ..... F01D 11/005 277/545
6,129,513 A * 10/2000 Halliwell ..... F01D 11/025 415/173.4
2004/0096312 A1* 5/2004 Tomko ..... F01D 5/147 415/110
2006/0197287 A1* 9/2006 Farah ..... F01D 11/003 277/549
2010/0247005 A1* 9/2010 Aschenbruck ..... F01D 9/023 384/15

(Continued)

*Primary Examiner* — Nathaniel Wiehe
*Assistant Examiner* — Eric Zamora Alvarez

(57) ABSTRACT

A sealing arrangement for a gas turbine including exhaust and manifold diffusers separated by a circumferential diffuser gap. The sealing arrangement includes a forward clamp arrangement attached to the exhaust diffuser wherein the forward clamp arrangement includes a forward groove. The sealing arrangement also includes an aft clamp arrangement attached to manifold diffuser wherein the aft clamp arrangement includes an aft groove. Further, the sealing arrangement includes a flexible circumferential seal including forward and aft loop portions. The forward loop portion is located in the forward groove and the aft loop portion is located in the aft groove wherein the circumferential seal extends across the circumferential diffuser gap to seal the circumferential diffuser gap. The forward and aft loop portions are moveable in the forward and aft grooves to enable movement of the circumferential seal in a circumferential direction to accommodate thermal expansion of the exhaust and manifold diffusers.

20 Claims, 6 Drawing Sheets

(56) References Cited

U.S. PATENT DOCUMENTS

| | | | | |
|---|---|---|---|---|
| 2011/0005234 | A1* | 1/2011 | Hashimoto | F01D 25/30 60/796 |
| 2013/0236305 | A1* | 9/2013 | Hashimoto | F01D 11/003 415/230 |

* cited by examiner

MOVEABLE SEALING ARRANGEMENT FOR A GAS TURBINE DIFFUSER GAP

FIELD OF THE INVENTION

The invention relates to a sealing arrangement for a gas turbine including an exhaust diffuser and a manifold diffuser separated by a circumferential diffuser gap, and more particularly, to a sealing arrangement having a forward clamp arrangement attached to the exhaust diffuser and an aft clamp arrangement attached to manifold diffuser and a flexible circumferential seal held between the forward and aft clamp arrangements to seal the circumferential diffuser gap and wherein the circumferential seal is moveable in a circumferential direction to accommodate thermal expansion of the exhaust and manifold diffusers in order to maintain the seal.

BACKGROUND OF THE INVENTION

Referring to FIG. 1, an axial flow gas turbine 10 includes a compressor section 12, a combustion section 14 and a turbine section 16 arranged along a central axis 17. The compressor section 14 provides a compressed air flow to the combustion section 14 where the air is mixed with a fuel, such as natural gas, and ignited to create a hot working gas. The hot gas expands through the turbine section 16 where it is directed across rows of blades therein by associated vanes. As the hot gas passes through the turbine section 16, it causes the blades to rotate, which in turn causes a shaft to rotate, thereby providing mechanical work.

The gas turbine 10 further includes an exhaust cylinder section 18 located between the turbine section 16 and an exhaust manifold section 20. Referring to FIG. 2, an enlarged view of balloon section 2 of FIG. 1 is shown which depicts the exhaust cylinder 18 and exhaust manifold 20. The exhaust cylinder 18 includes an exhaust cylinder flange 22 that is attached to an exhaust manifold flange 24 of the exhaust manifold 20 at a flange interface 26. The exhaust cylinder 18 and exhaust manifold 20 include an exhaust diffuser 28 and a manifold diffuser 30, respectively, arranged along the central axis 17. Hot gas 21 leaving a last row of turbine blades in the turbine section 16 is directed through a flow path formed by the exhaust 28 and manifold 30 diffusers. The exhaust 28 and manifold 30 diffusers are spaced apart to form a circumferential diffuser gap 32 in order to allow for thermal expansion during operation of the gas turbine 10. In addition, an annular cavity 34 is formed between the exhaust cylinder 18 and the exhaust diffuser 28. It is desirable to avoid the entry, or recirculation, of hot gas 21 into the cavity 34 via the gap 32 since this would subject the exhaust cylinder 18 to excessive heat leading to the formation of cracks in the exhaust cylinder 18 and struts located between an inner ring and an outer case of the gas turbine 10.

Many gas turbines include a plurality of stiff metal plate seal segments known as baffle plates 36 that extend between the exhaust cylinder 18 and the exhaust diffuser 28. The baffle plates 36 serve to prevent or hinder the flow of hot gas 21 into the cavity 34. However, the baffle plates 36 tend to crack due to being subjected to thermal cycling and varying engine vibration levels that occur during typical operation of the gas turbine 10. Further, replacement of the baffle plates 36 is labor intensive and expensive. Referring to FIG. 3, gas turbines may alternatively utilize a plurality of relatively stiff metal finger plate seals 38 that extend across the gap 32 between the exhaust diffuser 28 and the manifold diffuser 30 in order to prevent or hinder the flow of hot gas 21 into the cavity 34. It has been found that the finger plate seals 38 also tend to crack due to thermal cycling and varying engine vibration levels.

SUMMARY OF INVENTION

A sealing arrangement is disclosed for a gas turbine including an exhaust diffuser and a manifold diffuser separated by a circumferential diffuser gap. The sealing arrangement includes a forward circumferential clamp arrangement attached to the exhaust diffuser wherein the forward clamp arrangement includes a forward groove. The sealing arrangement also includes an aft circumferential clamp arrangement attached to manifold diffuser wherein the aft clamp arrangement includes an aft groove. Further, the sealing arrangement includes a flexible circumferential seal including forward and aft loop portions. The forward loop portion is located in the forward groove and the aft loop portion is located in the aft groove wherein the circumferential seal extends across the circumferential diffuser gap to seal the circumferential diffuser gap. In addition, the forward and aft loop portions are moveable in the forward and aft grooves to enable movement of the circumferential seal in a circumferential direction to accommodate thermal expansion of the exhaust and manifold diffusers in order to maintain the seal.

The circumferential seal may be formed from a flexible, heat resistant fabric. The circumferential seal may include at least one fold that unfolds as the gas turbine reaches operating temperature. This enables expansion of the circumferential seal in a circumferential direction to maintain a seal across the circumferential diffuser gap.

The sealing arrangement may also include a retention rod extending through the forward and aft loop portions wherein the forward and aft loop portions are moveable in the forward and aft grooves, respectively, to enable movement of the circumferential seal in a circumferential direction relative to the retention rods to accommodate thermal expansion of the exhaust and manifold diffusers.

The forward clamp arrangement may include an upper clamp attached to the exhaust diffuser, wherein the upper clamp includes a plurality of elongated holes. A spacer is located in each hole of the upper clamp, wherein the spacer includes a flange and wherein a flange gap is formed between the flange and the upper clamp to enable movement of the upper clamp relative to the spacer to accommodate thermal expansion that occurs in the upper clamp during operation of the gas turbine.

The respective features of the present invention may be applied jointly or severally in any combination or subcombination by those skilled in the art.

BRIEF DESCRIPTION OF DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

Figure 1:
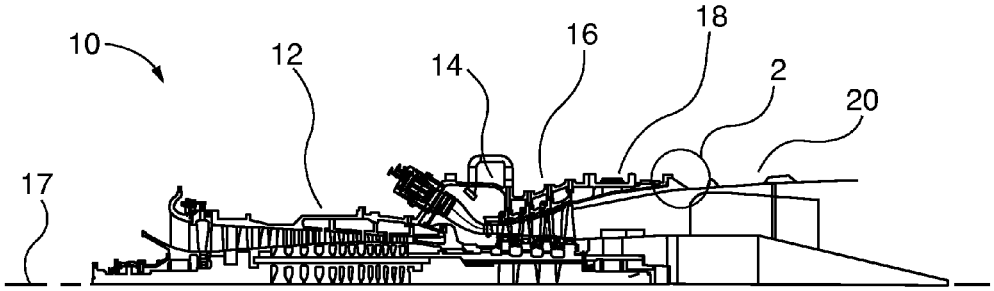
FIG. 1 PRIOR ART
FIG. 1 illustrates a cross sectional view of an axial flow gas turbine.
Figure 2:
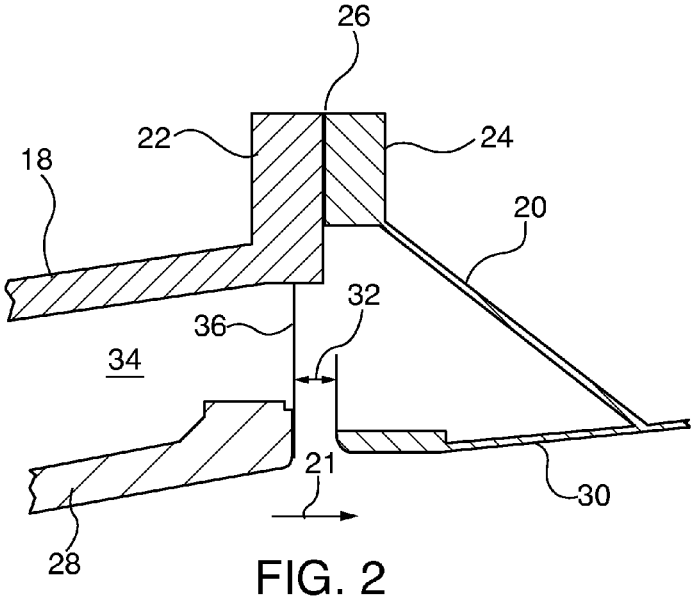
FIG. 2 PRIOR ART
FIG. 2 is an enlarged view of balloon section of FIG. 1.
Figure 3:
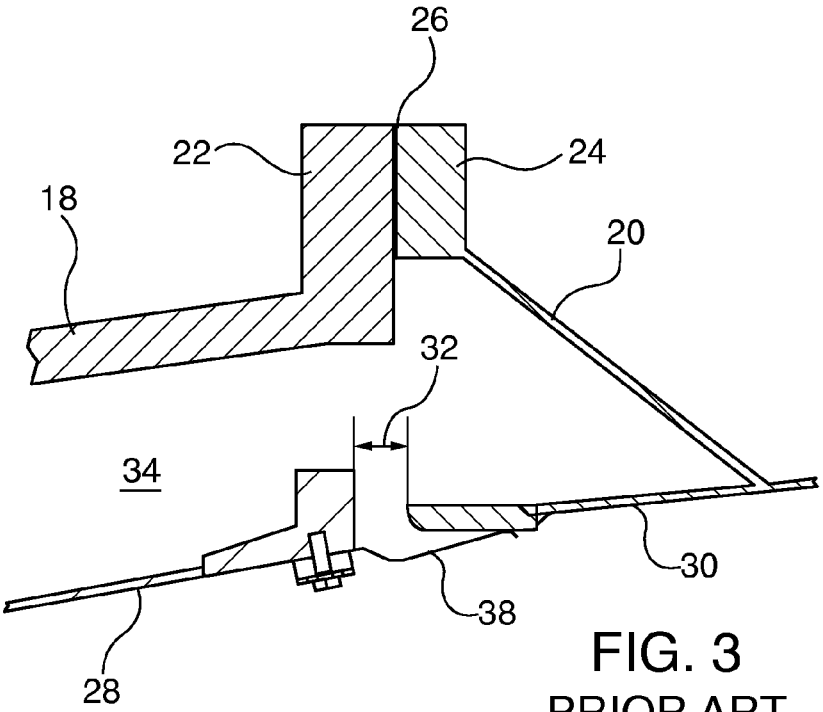
FIG. 3 PRIOR ART
FIG. 3 shows metal finger plate seals used to stop the flow of hot gas into a cavity of the gas turbine.

Although various embodiments that incorporate the teachings of the present invention have been shown and described in detail herein, those skilled in the art can readily devise many other varied embodiments that still incorporate these teachings. The invention is not limited in its application to the exemplary embodiment details of construction and the arrangement of components set forth in the description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings.

Figure 4:
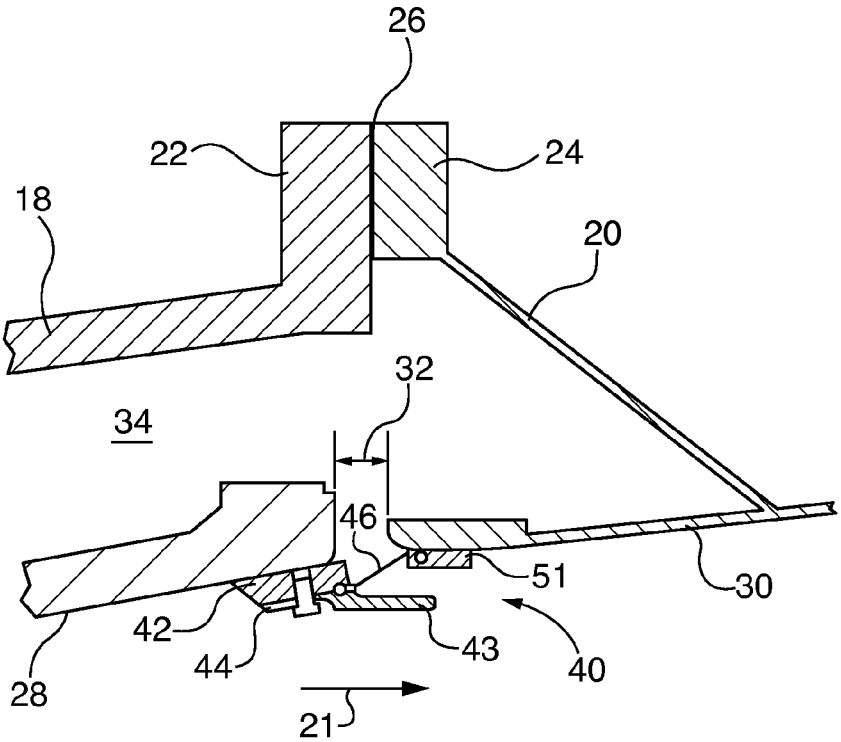
FIG. 4 is an overall view of a sealing arrangement for a gas turbine in accordance with the invention.

FIG. 4 depicts an overall view of a sealing arrangement 40 for an exhaust diffuser 28 and manifold diffuser 30 of a gas turbine 10. The sealing arrangement 40 includes a seal 46 located in the gap 32 between the exhaust diffuser 28 and the manifold diffuser 30. The seal 46 seals the gap 32 in order to hinder or stop the entry, or recirculation, of hot gas 21 into the cavity 34. This avoids subjecting the exhaust cylinder 18 to excessive heat that might lead to the formation of cracks in the exhaust cylinder 18 and struts located between an inner ring and an outer case of the gas turbine 10.

Figure 5:
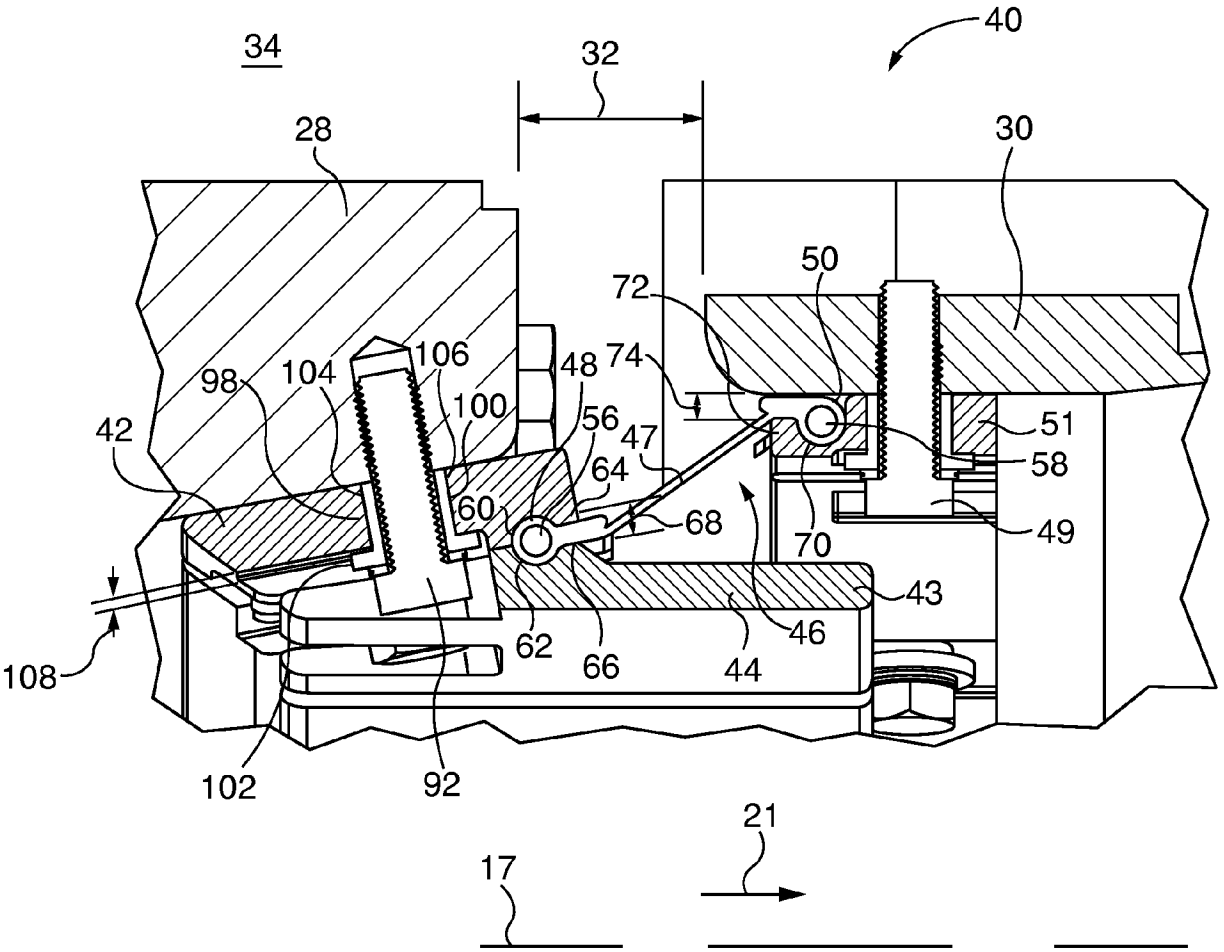
FIG. 5 shows an enlarged view of the sealing arrangement.
Figure 6:
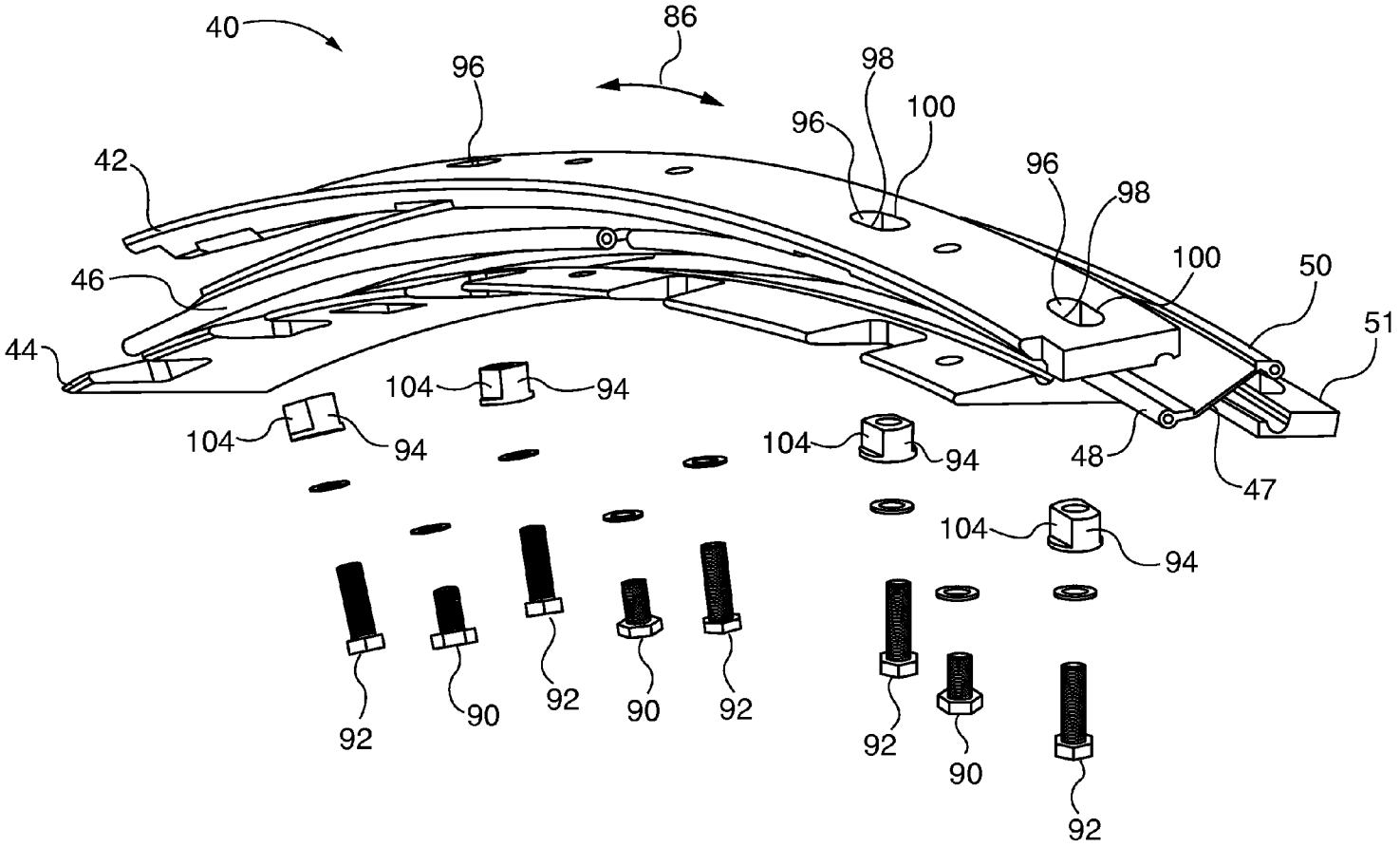
FIG. 6 is an exploded view of the sealing arrangement.

FIG. 5 is an enlarged view of the sealing arrangement 40. FIG. 6 is an exploded view of the sealing arrangement 40. Referring to FIG. 6 in conjunction with FIG. 5, the seal 46 has a curved configuration and includes a flexible center sealing portion 47 located between forward 48 and aft 50 loop portions. The sealing arrangement 40 also includes upper 42 and lower 44 forward clamps for holding the forward loop portion 48 and an aft clamp 51 for holding the aft loop portion 50. A plurality of sealing arrangements 40 are arranged circumferentially about the central axis 17 to circumferentially seal the gap 32 between the exhaust 28 and manifold 30 diffusers. In one embodiment, twelve sealing arrangements 40 are used to seal the gap 32. In addition, the lower clamp 44 includes an outwardly extending flow shield portion 43 that is adjacent a flow path for the hot gas 21 and serves to shield the seal 46 from the hot gas 21.

Figure 7:
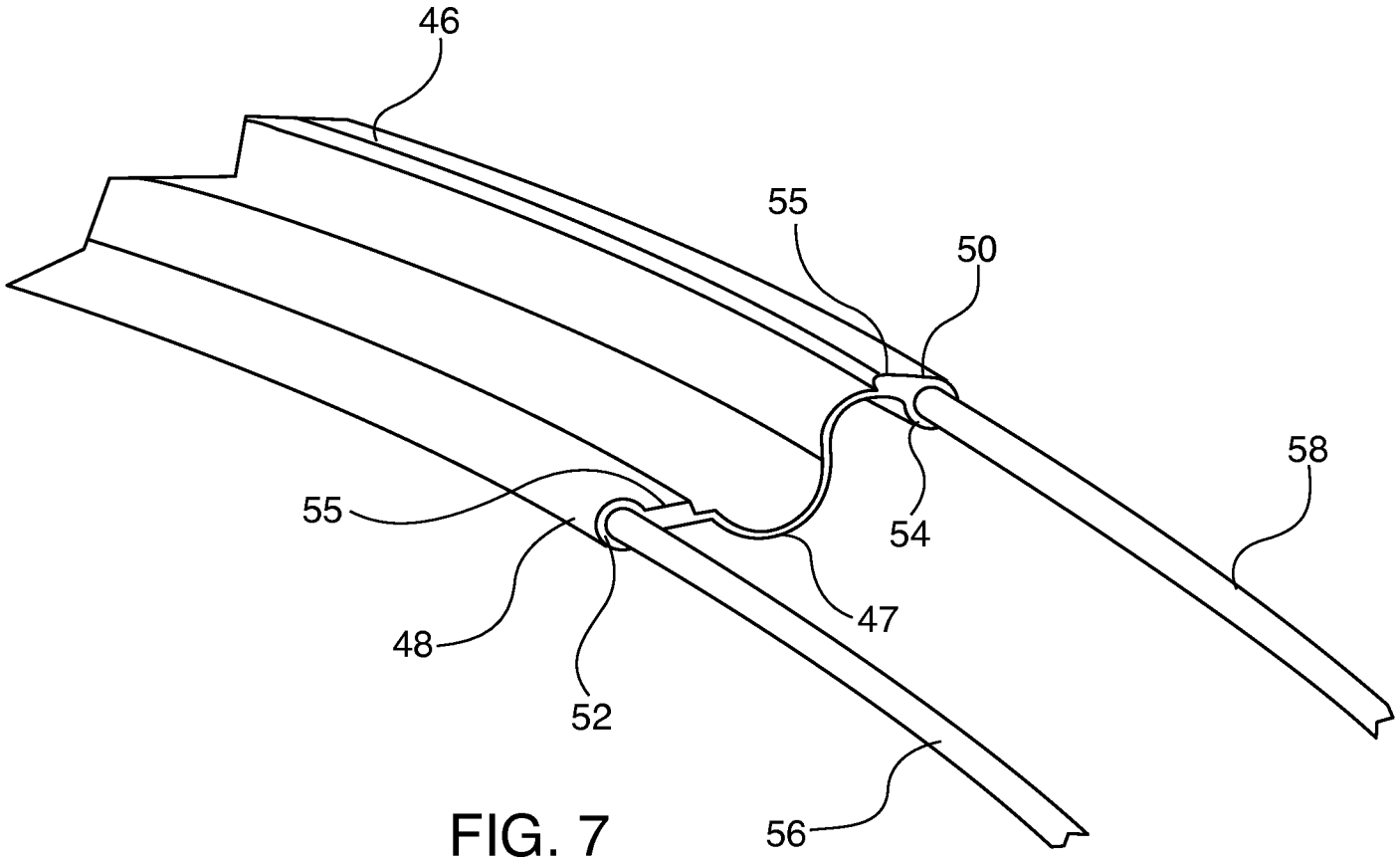
FIG. 7 is a perspective view of a seal in accordance with the invention.

Referring to FIG. 7, a perspective view of the seal 46 is shown. The seal 46 is fabricated from a flexible fabric material having heat resistant properties sufficient to withstand exposure to the hot gas 21 generated by the gas turbine 10. In an embodiment, the seal 46 may have a dual layer construction wherein a first layer that faces the hot gas 21 has high heat resistant properties sufficient to withstand exposure to the hot gas 21 and a second layer, that does not face the hot gas 21, has lower heat resistant properties. By way of example, the seal 46 may be fabricated from a layer of Z-Block™ F-407 fabric and a layer of ZetexPlus® A-820 fabric both sold by Newtex Industries, Inc.

The forward 48 and aft 50 loop portions of the seal 46 are formed by looping front and aft edges of the fabric material into a circular configuration to form forward 52 and aft channels 54, respectively. Overlapping portions 55 of the fabric material are then fastened to each other by stitching, for example. It is understood that other configurations may be used to form the seal 46 such as by attaching separately fabricated forward 48 and aft 50 loop portions to the sealing portion 47. Forward 56 and aft 58 retention rods having a curved configuration extend through the forward 52 and aft 54 channels, respectively. The forward 52 and aft channels 54 are sized to enable movement of the forward 48 and aft 50 loop portions, and thus the seal 46, relative to the forward 56 and aft 58 retention rods, respectively. Further, the forward 56 and aft 58 retention rods support and guide movement of the forward 48 and aft 50 loop portions.

Referring back to FIGS. 5 and 6, the forward loop portion 48 and forward retention rod 56 together form a forward loop/rod assembly 48, 56. The forward loop/rod assembly 48, 56 is positioned between upper 60 and lower 62 grooves formed in the upper 42 and lower 44 clamps, respectively. The upper 60 and lower 62 grooves are sized to enable circumferential movement of the forward loop portion 48 about the central axis 17 relative to the upper 42 and lower 44 clamps. The upper 42 and lower 44 clamps include upper 64 and lower 66 retaining portions separated by a forward retaining gap 68. The forward retaining gap 68 is sized smaller than the forward loop/rod assembly 48, 56 in order to retain the forward loop/rod assembly 48, 56 in the upper 60 and lower 62 grooves.

The aft loop portion 50 and aft retention rod 58 together form an aft loop/rod assembly 50, 58, The aft loop/rod assembly 50, 58 is positioned between a groove 70 formed in the aft clamp 51 and the manifold diffuser 30. The groove 70 is sized to enable circumferential movement of the aft loop 50 about the central axis 17 relative to the aft clamp 51. The aft clamp 51 includes an aft retaining portion 72 that is separated from the manifold diffuser 30 by an aft retaining gap 74. The aft retaining gap 74 is sized smaller than the aft loop/rod assembly 50, 58 in order to retain the aft loop/rod assembly 50, 58 in the groove 70. The aft clamp 51 is attached to the manifold diffuser 30 by a fastener 49.

Figure 8:
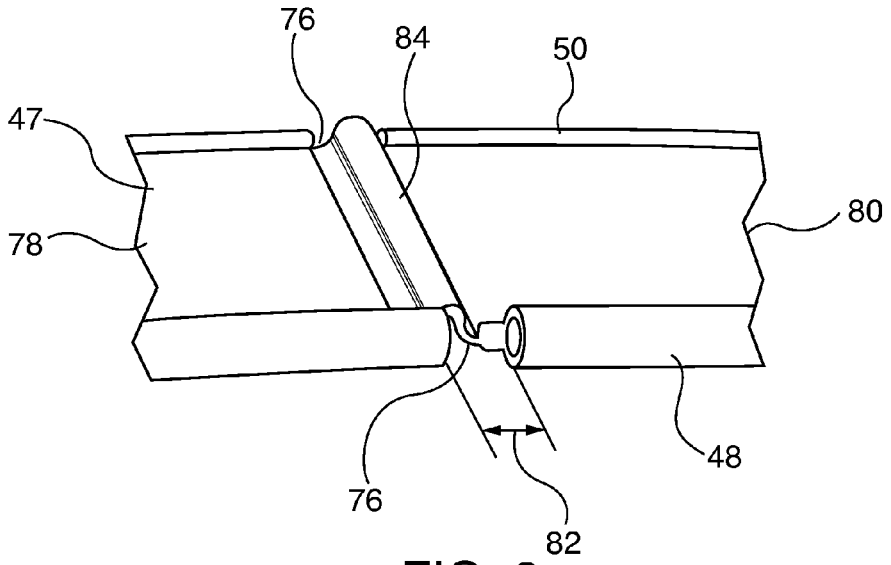
FIG. 8 shows relief cuts formed in both forward and aft loop portions of the seal.
Figure 9:
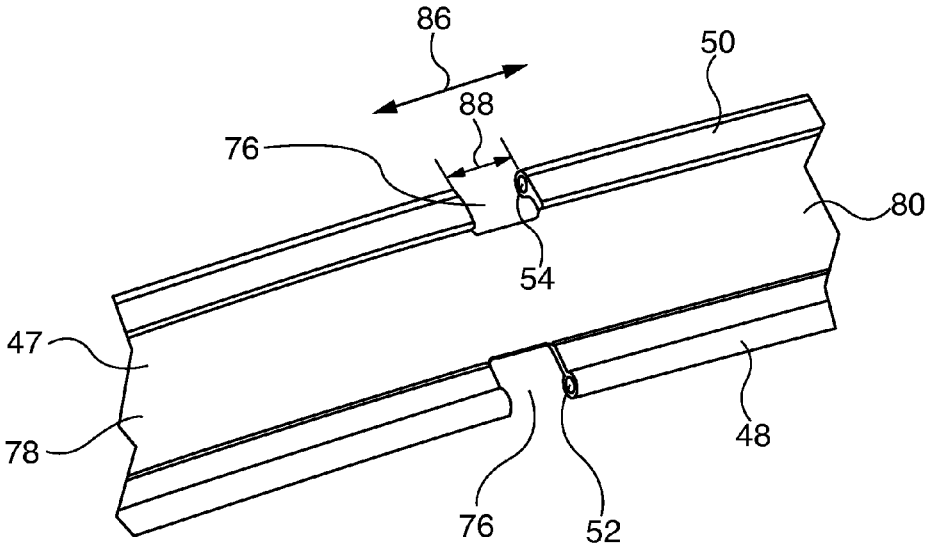
FIG. 9 shows an unfolded sealing portion of the seal to enable movement of the seal in a circumferential direction.

Referring to FIG. 8, relief cuts 76 are made at predetermined locations in both the forward 48 and aft 50 loop portions. The relief cuts 76 form first 78 and second 80 seal segments that are attached by the sealing portion 47. The relief cuts 76 enable movement of the first 78 and second 80 seal segments relative to each other. The first 78 and second 80 seal segments are assembled close to each other and are separated by a first loop gap 82 such that at least one fold 84 is formed in the sealing portion 47. As the gas turbine 10 reaches operating temperature during use, the exhaust 28 and manifold 30 diffusers expand in a radial direction thus increasing their circumference. This causes either the first 78 or second 80 seal segments, or both the first 78 and second 80 seal segments, to move in grooves 60, 62, 70 away from each other in a circumferential direction 86. Referring to FIG. 9, this in turn causes the fold 84 to unfold such that the first 78 and second 80 sealing portions are separated by a second loop gap 88 that is larger than the first loop gap 82 and enabling the seal 46 to expand in the circumferential direction 86 to maintain a seal across gap 32.

Referring back to FIGS. 5 and 6, the lower forward clamp 44 is attached to the upper clamp 42 by first plurality of fasteners 90. The upper clamp 42 includes a plurality of slotted or elongated holes 96 that receive associated spacers 94. The upper clamp 42 is attached to the exhaust diffuser 28 by a second plurality of fasteners 92 that extend through associated spacers 94 and are threadably engaged into the exhaust diffuser 28. Each hole 96 includes a pair of spaced apart first 98 and second 100 straight sections that are oriented in the circumferential direction 86. Each spacer 94 includes a flange 102 and first 104 and second 106 flat surfaces located between the first 98 and second 100 straight sections. The flat surfaces 104, 106 and the straight sections 98, 100 serve to guide movement of the upper clamp 42 in the circumferential direction 86. The flange 102 serves to retain the upper clamp 42. In addition, the flange 102 is configured such that a flange gap 108 is formed between an underside of the flange 102 and the upper clamp 42. This provides a clearance to enable movement of the upper clamp 42 relative to the spacer 94 in the circumferential direction 86 to accommodate thermal expansion that occurs in the upper clamp 42 during operation of the gas turbine 10. This reduces stress points in the upper clamp 42 and increases longevity of the upper clamp 42. In one embodiment, the flange gap 108 is approximately 1.4 mm.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A sealing arrangement for a gas turbine including an exhaust diffuser and a manifold diffuser separated by a circumferential diffuser gap, comprising:

a forward clamp arrangement including upper and lower clamps attached to the exhaust diffuser wherein the upper and lower clamps include upper and lower grooves, respectively;

an aft clamp arrangement attached to the manifold diffuser wherein the aft clamp arrangement includes an aft groove; and a circumferential seal including forward and aft loop portions, wherein the forward loop portion is located between the upper and lower grooves and the aft loop portion is located in the aft groove and wherein the circumferential seal extends across the circumferential diffuser gap to seal the circumferential diffuser gap and wherein the forward and aft loop portions are moveable in the upper, lower and aft grooves to enable movement of the circumferential seal in a circumferential direction to accommodate thermal expansion of the exhaust and manifold diffusers.

2. The sealing arrangement according to claim 1, wherein the forward and aft loop portions each include a retention rod for guiding movement of the circumferential seal.

3. The sealing arrangement according to claim 1, wherein the circumferential seal includes at least one fold.

4. The sealing arrangement according to claim 3, wherein the fold becomes unfolded to accommodate thermal expansion that occurs during operation of the gas turbine.

5. The sealing arrangement according to claim 1, wherein the forward and aft loop portions each include a relief cut to form moveable first and second circumferential seal segments.

6. The sealing arrangement according to claim 1, wherein the circumferential seal is formed from a heat resistant fabric.

7. The sealing arrangement according to claim 1, wherein the circumferential seal includes a plurality of sealing arrangement segments.

8. A sealing arrangement for a gas turbine including an exhaust diffuser and a manifold diffuser separated by a circumferential diffuser gap, comprising:

upper and lower clamps attached to the exhaust diffuser wherein the upper and lower clamps include upper and lower grooves, respectively;

an aft clamp arrangement attached to the manifold diffuser wherein the aft clamp arrangement includes an aft groove;

a circumferential seal including forward and aft loop portions, wherein the forward loop portion is located between the upper and lower grooves and the aft loop portion is located in the aft groove and wherein the circumferential seal extends across the circumferential diffuser gap to seal the circumferential diffuser gap; and forward and aft retention rods extending through the forward and aft loop portions, respectively, wherein the forward and aft loop portions are moveable in the upper, lower and aft grooves, respectively, to enable movement of the circumferential seal in a circumferential direction relative to the forward and aft retention rods to accommodate thermal expansion of the exhaust and manifold diffusers.

9. The sealing arrangement according to claim 8, wherein the upper and lower clamps include upper and lower retaining portions, respectively, and the aft clamp arrangement includes an aft retaining portion wherein the upper, lower and aft retaining portions retain the forward and aft loop portions in the upper, lower and aft grooves, respectively.

10. The sealing arrangement according to claim 8, wherein the circumferential seal includes at least one fold.

11. The sealing arrangement according to claim 10, wherein the fold becomes unfolded to accommodate thermal expansion that occurs during operation of the gas turbine.

12. The sealing arrangement according to claim 8, wherein the forward and aft loop portions each include a relief cut to form moveable first and second circumferential seal segments.

13. The sealing arrangement according to claim 8, wherein the circumferential seal is formed from a heat resistant fabric.

14. The sealing arrangement according to claim 8, wherein the circumferential seal includes a plurality of sealing arrangement segments.

15. An exhaust system for a gas turbine having a compressor section, a combustion section and a turbine section arranged on a central axis, comprising:

an exhaust cylinder located adjacent to the turbine section, wherein the exhaust cylinder includes an exhaust diffuser arranged on the central axis;

an exhaust manifold having a manifold diffuser that is spaced apart axially from the exhaust diffuser by a circumferential diffuser gap;

an upper clamp attached to the exhaust diffuser, wherein the upper clamp includes an upper groove and a plurality of elongated holes;

a spacer located in each hole of the upper clamp, wherein the spacer includes a flange and wherein a flange gap is formed between the flange and the upper clamp to enable movement of the upper clamp relative to the spacer to accommodate thermal expansion that occurs in the upper clamp during operation of the gas turbine;

a lower clamp attached to the upper clamp, wherein the lower clamp has a lower groove;

an aft clamp arrangement attached to the manifold diffuser wherein the aft clamp arrangement includes an aft groove;

a circumferential seal including forward and aft loop portions, wherein the forward loop portion is located between the upper and lower grooves and the aft loop portion is located in the aft groove and wherein the circumferential seal is arranged on the central axis and extends across the circumferential diffuser gap to seal the circumferential diffuser gap; and forward and aft retention rods extending through the forward and aft loop portions, respectively, wherein the forward and aft loop portions are moveable in the upper, lower and aft grooves, respectively, to enable movement of the circumferential seal in a circumferential direction relative to the forward and aft retention rods to accommodate thermal expansion of the exhaust and manifold diffusers.

16. The exhaust system according to claim 15, wherein the upper and lower clamps include upper and lower retaining portions, respectively, and the aft clamp arrangement includes an aft retaining portion wherein the upper, lower and aft retaining portions retain the forward and aft loop portions in the upper, lower and aft grooves, respectively.

17. The exhaust system according to claim 15, wherein the circumferential seal includes at least one fold.

18. The exhaust system according to claim 17, wherein the fold becomes unfolded to accommodate thermal expansion that occurs during operation of the gas turbine.

19. The exhaust system according to claim 15, wherein the forward and aft loop portions each include a relief cut to form moveable first and second circumferential seal segments.

20. The exhaust system according to claim 15, wherein the flange gap is approximately 1.4 mm.

* * * * *